US005261603A

United States Patent [19]

Driska

[11] Patent Number: 5,261,603

[45] Date of Patent: Nov. 16, 1993

[54] ANIMAL-LIKE WATER SPRAYER

[75] Inventor: John J. Driska, Princeton Junction, N.J.

[73] Assignee: Azrak-Hamway International, Inc., New York, N.Y.

[21] Appl. No.: 919,054

[22] Filed: Jul. 23, 1992

[51] Int. Cl.[5] ..... B05B 1/16/3/00

[52] U.S. Cl. ..... 239/211; 239/251; 239/261; 239/289

[58] Field of Search ..... 239/211, 251, 261, 289; D23/215; 446/223, 226, 199, 276, 153

[56] References Cited

U.S. PATENT DOCUMENTS

| | | | |
|---|---|---|---|
| D. 176,556 | 1/1956 | Russell | D23/215 |
| 664,730 | 12/1900 | Dengler | 239/211 |
| 1,918,874 | 7/1933 | Shannahan | 239/211 X |
| 2,030,605 | 2/1936 | Moore | 239/211 |
| 2,046,225 | 6/1936 | Vickery | 239/211 X |
| 2,087,175 | 7/1937 | Voight | 239/211 X |
| 2,241,092 | 5/1941 | Jurgilanis | 239/211 X |
| 2,670,992 | 3/1954 | Long | 239/211 |
| 3,820,715 | 6/1974 | Hamilton | 239/211 X |
| 4,205,785 | 6/1980 | Stanley | 239/211 X |
| 4,235,378 | 11/1980 | Melin et al. | 446/153 X |
| 4,261,514 | 4/1981 | Kennard et al. | 239/211 |
| 5,111,993 | 5/1992 | Baker | 239/211 |

FOREIGN PATENT DOCUMENTS

| | | | |
|---|---|---|---|
| 2301305 | 10/1976 | France | 239/211 |

*Primary Examiner*—Andres Kashnikow
*Assistant Examiner*—Lesley D. Morris
*Attorney, Agent, or Firm*—Amster, Rothstein & Ebenstein

[57] ABSTRACT

A garden-type water sprayer includes a figure configured as an animal and defining a stationary body part and at least one movable body part. A drive is mounted on the figure and adapted for fluid communication with a water supply under pressure, the drive directing a water spray against the at least one movable body part to move the same.

17 Claims, 8 Drawing Sheets

ANIMAL-LIKE WATER SPRAYER

BACKGROUND OF THE INVENTION

The present invention relates to a water distribution system, and more particularly, to an above-ground water distribution system capable of providing both a spray and a stream.

It is known to provide an above-ground water distribution system for use on a lawn wherein the system permits creation of either a spray of water so that children can play therein (e.g., running through the spray and the like) or a stream for providing a heavy concentration of water in a local area, as by means of a hose and output nozzle. Depending upon the positioning of a selector lever, the water can be discharged via an outlet nozzle either as a spray or as a stream. While the spray is capable of many uses, it is frequently primarily designed for use by children playing therein. The output nozzle is typically adapted to receive one end of a garden hose and provide a water supply thereto so that the other end of the lawn hose may be used to water shrubs, fill containers, wash cars, and the like.

A known water distribution system has the appearance of a fire hydrant to which a lawn hose can be connected as input. While the "fire hydrant" system provides the desired functionality, it is grossly lacking in both aesthetic appeal and play value. The appearance of the fire hydrant-like system is that of a fire hydrant and, thus, lacks any aesthetic appeal. The fire hydrant system may provide water as desired, but it is hardly the type of toy a child would play with for its "fun" value since it lacks moving parts, cuteness, or the like.

Accordingly, it is an object of the present invention to provide an above-ground water distribution system which is aesthetically appealing.

Another object is to provide such a system which has a high degree of play value and is interesting to watch in operation, even when the observer is not "playing" in the water emitted therefrom.

A further object is to provide such a system which is inexpensive and easy to manufacture, maintain and use.

SUMMARY OF THE INVENTION

It has now been found that the above and related objects of the present invention are obtained in an above-ground water distribution system according to the present invention. The system includes a garden-type water sprayer comprising a figure configured as an animal and defining a stationary body part and at least one movable body part. Drive means are mounted on the figure and adapted for fluid communication with a water supply under pressure, the drive means defining means for directing a water spray against the at least one movable body part to move the same.

In a preferred embodiment, the drive means comprises at least a pair of jets for alternately directing a pair of water sprays against the at least one movable part. The stationary body part is the torso and limbs of the figure and the at least one movable body part includes the head of the figure. The figure further defines a neck connecting the head and the torso together while permitting limited movement of the head relative to the torso at least along a predetermined generally arcuate axis, and the drive means includes means for causing the water from the water supply to move the head relative to the torso to shake the head.

The present invention additionally encompasses a garden-type water sprayer comprising a figure configured as an animal and defining a torso, a head, a neck connecting the head and the torso together (while permitting limited movement of the head relative to the torso at least along a predetermined generally arcuate axis), a pair of ears secured to the head for movement relative thereto, and a tail secured to the torso for movement relative thereto. A collar is disposed about the neck and adapted for fluid communication with a water supply under pressure, the collar defining at least a pair of rearwardly directed jets for alternately directing water sprays against the tail to wag the tail, at least a pair of forwardly directed jets for directing a water spray against each of the ears to flap the ears, and means for causing the water from the water supply to move the head relative to the torso to rotate the head.

In a preferred embodiment, an output nozzle is configured as a bone and a flexible conduit of appreciable length is configured as a leash for fluid communication between the output nozzle and the collar. The head defines a mouth configured and dimensioned to receive and releasably maintain the output nozzle in the mouth. A tag secured to the collar is movable between a spray-feed orientation and a nozzle-feed orientation. A valve disposed in the collar is operably connected to the tag, the valve being in fluid communication with the jets and head-moving means when the tag is in the spray-feed orientation and in fluid communication with the nozzle when the tag is in the nozzle-feed orientation.

In another preferred embodiment, the torso is hollow and defines a connector in fluid communication with a water supply under pressure at one end and the collar at the other end. Means secure the tail to the torso while permitting limited lateral movement of the tail relative to the torso under the impact of the water sprays. The tail is flexible and wags under the alternating impacts of the water sprays. Additionally, means secure each of the ears to the head while permitting pivotal motion of the ears under the impact of the water sprays. Each of the ears is flexible and flaps under the impact of the water spray. Finally, the neck enables limited rotational motion of the head relative to the torso, including limited horizontal and vertical motion of the head relative to the torso. The water from the water supply passes through the head-moving means of the collar, and thus causes shaking of the head, prior to entering the rearwardly directed jets of the collar.

BRIEF DESCRIPTION OF THE DRAWINGS

The above and related objects, features and advantages of the present invention will be more fully understood by reference to the following detailed description of the presently preferred, albeit illustrative, embodiments of the present invention when taken in conjunction with the appended drawing wherein.

DETAILED DESCRIPTION OF PREFERRED EMBODIMENTS

Figure 1:
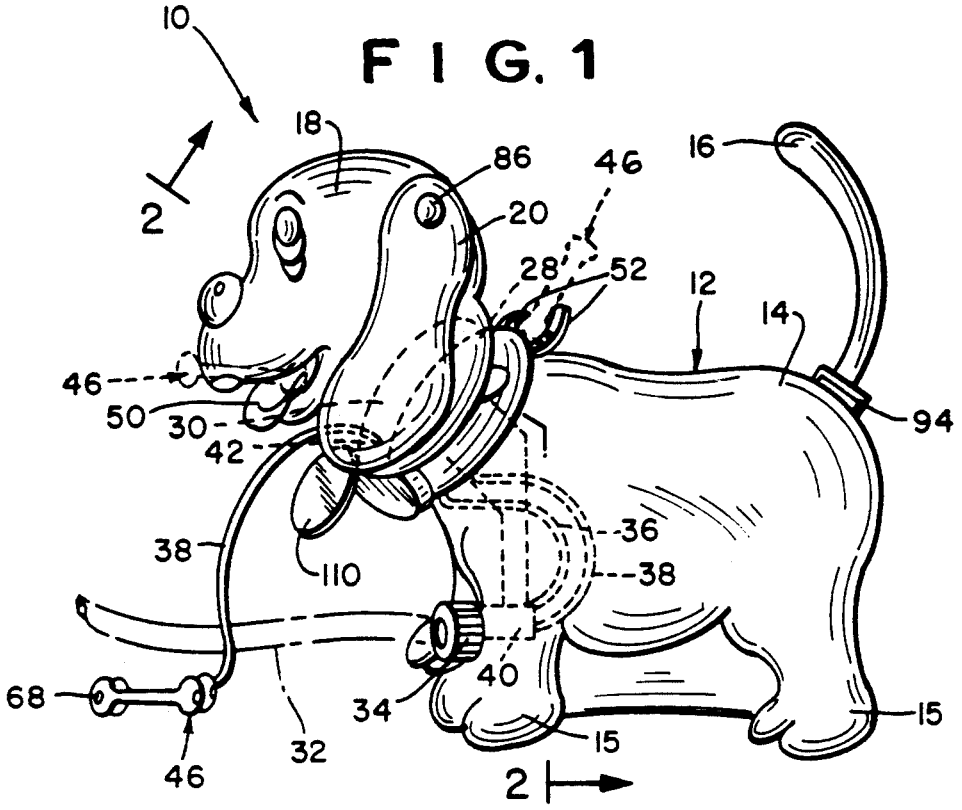
FIG. 1 is a side elevational view of a system according to the present invention in the configuration of a dog with a shaking head, flapping ears and a wagging tail.

Referring now to the drawing, and in particular FIG. 1 thereof, therein illustrated is a garden-type water sprayer according to the present invention, generally designated by the reference numeral 10. The sprayer 10 is in the form of a figure generally designated 12 and comprises an above-ground water distribution system for use on lawns, gardens and like. The FIG. 12 is an animal and, while illustrated herein as a cute little dog, may be any real or imaginary creature desired, including humans, cartoon characters or the like. The dog 12 defines at least one stationary body part, illustrated herein as the torso 14 and legs 15, and at least one movable body part, illustrated herein as a tail 16, a head 18 and a pair of ears 20.

During one mode of operation of the device 10, the tail 16 wags from side to side relative to the stationary body part; the head 18 shakes, rotating clockwise and counterclockwise relative to the stationary body part; and each of the ears 20 flaps up and down independently, away from and towards the head 18. The four moving components 16, 18, 20, 20 provide the image of a very animated and friendly dog. Of course, while the body parts 14, 15 have been described as stationary, in fact the entire FIG. 12 may be picked up and moved to any desired location, and the stationary body parts are thus stationary only in the sense that they do not move in response to the fluid flow through the device.

More particularly, a neck 28 connects the stationary torso 14 and the movable head 18 together while permitting limited movement of the head 18 relative to the torso 14 at least along a predetermined generally arcuate axis, which includes limited horizontal and vertical displacements so as to provide the appearance of the head 18 rotating clockwise and counterclockwise about a tilted linear axis extending from the head 18 through the neck 28 and into the torso 14. A collar 30 is mounted on the FIG. 12 about the neck 28 thereof and defines drive means adapted for fluid communication with a fluid supply under pressure, such as the water supply provided by a tube 32 (illustrated in phantom line) and connected to an inlet nozzle 34 conveniently located on the stationary torso 14 (typically disposed in the front of the torso 14 intermediate the front legs). The tube 32 may be a common flexible garden hose or a more permanent above- or below-ground water supply.

Figure 3:
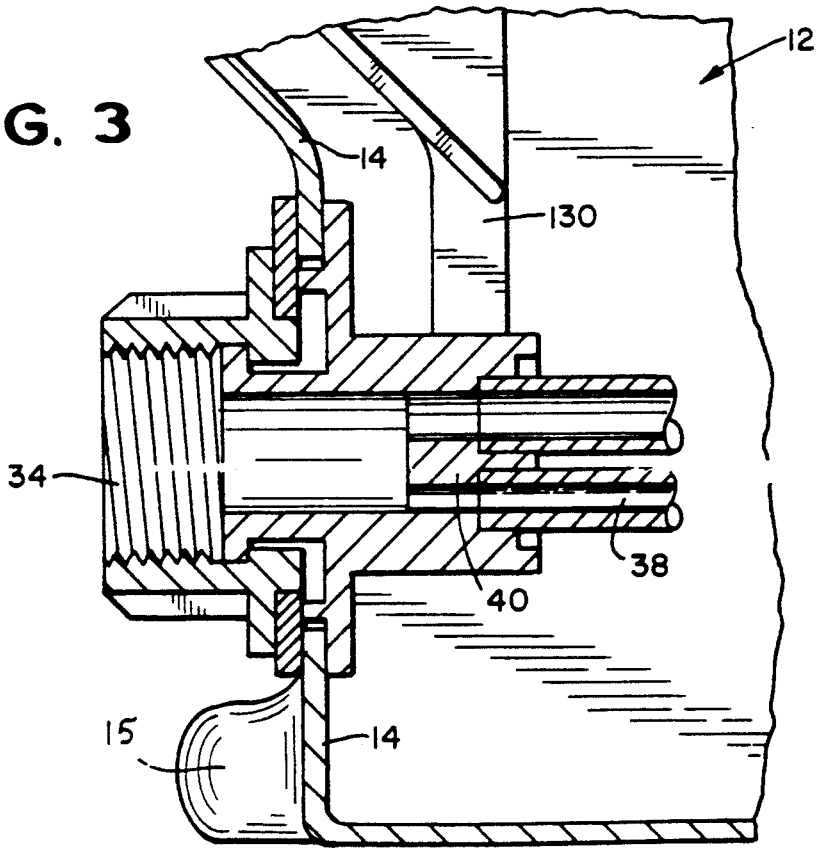
FIG. 3 is a fragmentary sectional view of the output nozzle region, to a greatly enlarged scale.
Figure 2:
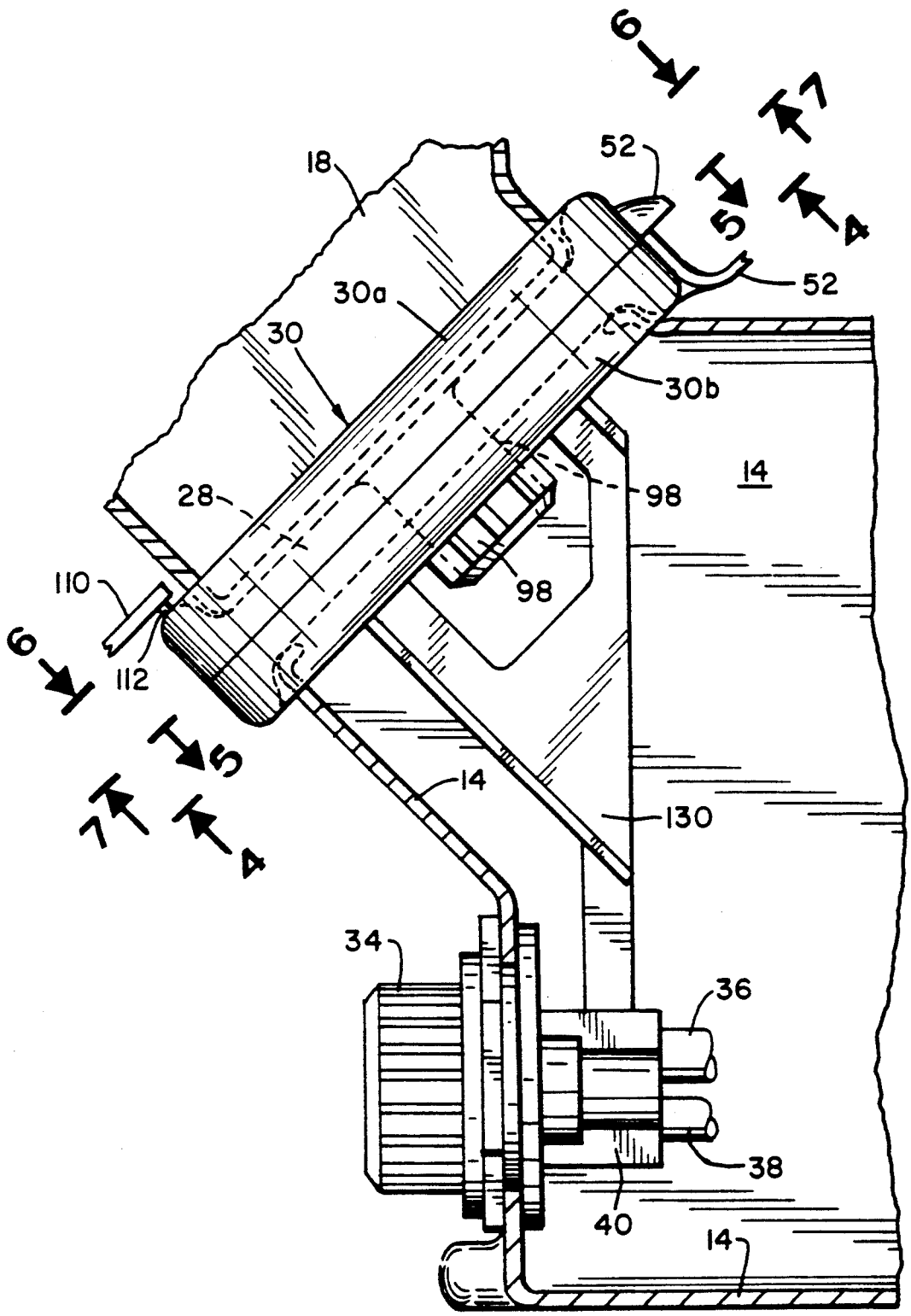
FIG. 2 is a fragmentary sectional view taken along the line 2—2 of FIG. 1, to an enlarged scale.

Referring now to FIGS. 2 and 3 as well, the water or like fluid entering inlet nozzle 34 flows into two flexible watertight conduits 36 and 38. The torso 14 is basically hollow so that the conduits 36 and 38 can extend through the torso from the input nozzle 34 through the neck 28 intermediate the torso 14 and head 18 and thence into the collar 30.

In order to facilitate the making of a watertight engagement between the hose 32 and the input nozzle 34, the input nozzle 34 is rotatably mounted on the stationary torso 14 so that the externally threaded end of the hose 32 may be held stationary and the internally threaded input nozzle 34 rotated relative thereto, thereby to effect the desired watertight threaded engagement. An intermediate nozzle part 40 is generally fixedly secured to the torso 14 and has a front end adapted to rotatably mount the input nozzle 34 thereon and a rear end adapted to fixedly mount therein the ends of conduits 36 and 38.

The conduit 38 passes through an opening 42 in the collar, extends outwardly from the FIG. 12, and terminates in a component generally designated 46. The portion of conduit 38 extending between the collar 30 and the component 46, which preferably has the appearance of a leash connecting the collar 30 and component 46, provides fluid communication between the hose 32 and the component 46 via input nozzle 34 and intermediate nozzle part 40. The component 46, which preferably has the appearance of a bone, is configured and dimensioned so that it may be comfortably held in a user's hand, or releasably secured either horizontally in the dog's mouth 50 or vertically between two arms 52 extending upwardly from the collar 30.

Figure 9:
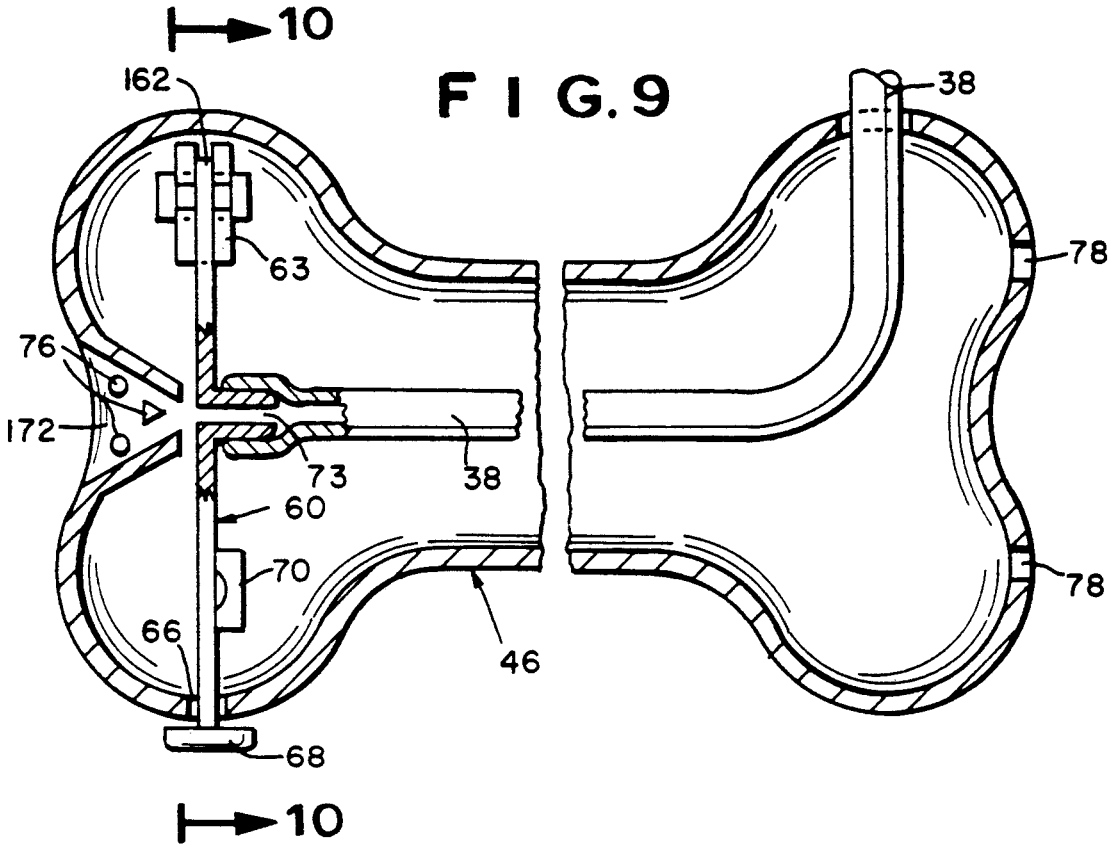
FIG. 9 is a sectional view of the bone illustrated in FIG. 1, to an enlarged scale.
Figure 10:
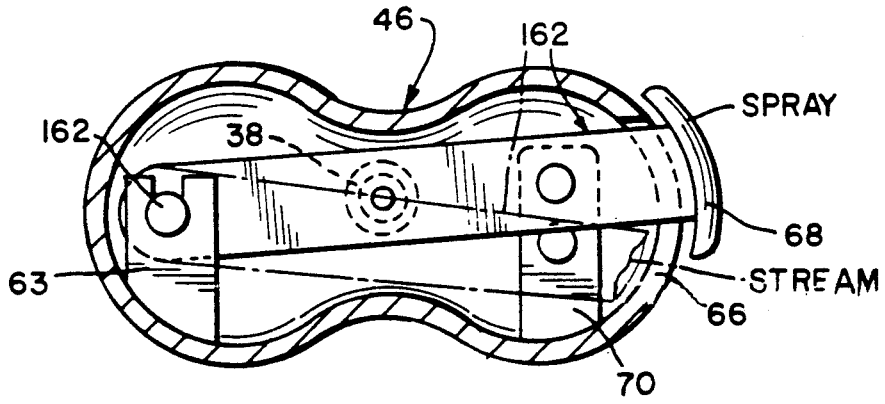
FIG. 10 is a sectional view taken along the line of 10—10 of FIG. 9.

Referring now in particular to FIGS. 9 and 10, the conduit 38 enters the bone 46 adjacent one end thereof and has its free end mounted on a lever generally designated 60. The lever 160 has one end 162 pivotally mounted on a pivot block 63 of bone 46 and the other end extending through a slot 66 in the wall of bone 46 and terminating outside of the bone 46 in an enlarged head 68. By judicious movement of the lever head 68 (for example, by the thumb of the user), the lever 160 may be pivoted between first and second extreme positions, the lever being held in each of the extreme positions by means of a conventional resilient detent/projection mechanism 170. The free end of conduit 38 secured to lever 160 is at all times aligned with an aperture 172 disposed at the other end of the bone 46, the lever 160 itself being provided with an opening 73 at its juncture with the free end of conduit 38 to enable passage of fluid from the conduit 38 into and through bone aperture 172.

Disposed on the downstream side of aperture 172 are a plurality of dispersing elements 76. When the lever 160 is in one extreme position, the fluid stream emitted from conduit 38 through the lever opening 73 passes through the bone aperture 172 without contacting the dispersing elements 76, and thus emerges as a well-defined solid stream. On the other hand, when the lever 160 is in the other extreme position, that same fluid flow emerging from the lever opening 73 engages the dispersing elements 76 in bone aperture 172, which elements 76 cause the fluid stream to disperse and emerge from the bone aperture 172 as a spray. Accordingly, depending upon the setting of the lever head 68, the user can control the fluid flow emerging from bone 46 and obtain either a solid stream or a dispersed spray. The bone 46 preferably defines, at the end opposite the bone aperture 172, a plurality of small openings 78 to enable an air flow through the bone 46 from end to end. It will be appreciated that the spray/stream nature of the fluid flow emerging from the bone 46 is maintained by the detent/projection mechanism 170, even when the bone 46 is mounted in the mouth 50 of the dog or between the collar arms 52, until the lever 160 is intentionally moved.

It will be appreciated that the conduit 38 and bone 46, while only optional components of the present invention, provide a desirable level of flexibility in function by enabling the sprayer 10 of the present invention to provide a stream or spray, as desired, either at a point adjacent to or removed from the FIG. 12, depending upon whether it is mounted on the FIG. 12 (for example, as illustrated in phantom line in FIG. 1 in the mouth 50 or on the collar arms 52) or manually held by a user at a distance from the FIG. 12 limited only by the length of the leash (that is, the portion of conduit 38 extending from the collar 30 to the bone 46).

Figure 5:
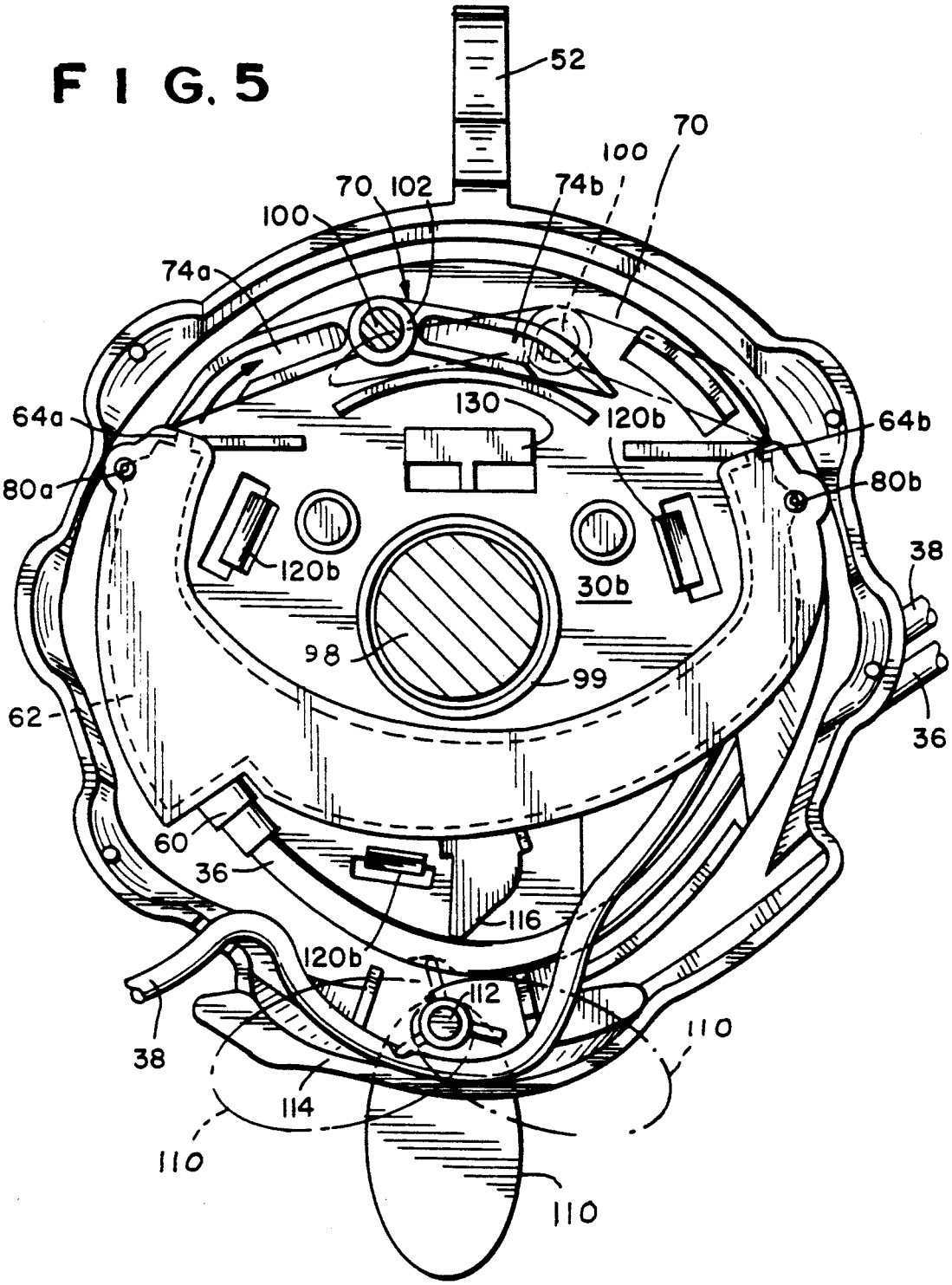

Returning now to the other conduit, and referring in particular to FIG. 5, the other end of conduit 36 terminates in a watertight connection 60 to an interior watertight chamber 62 of the collar 30. The chamber 62 is U-shaped and defines adjacent the free ends thereof jet apertures 64a and 64b. Thus fluid entering the collar 30 from conduit 36 emerges under pressure from the two jet apertures 64a, 64b.

Figure 6:
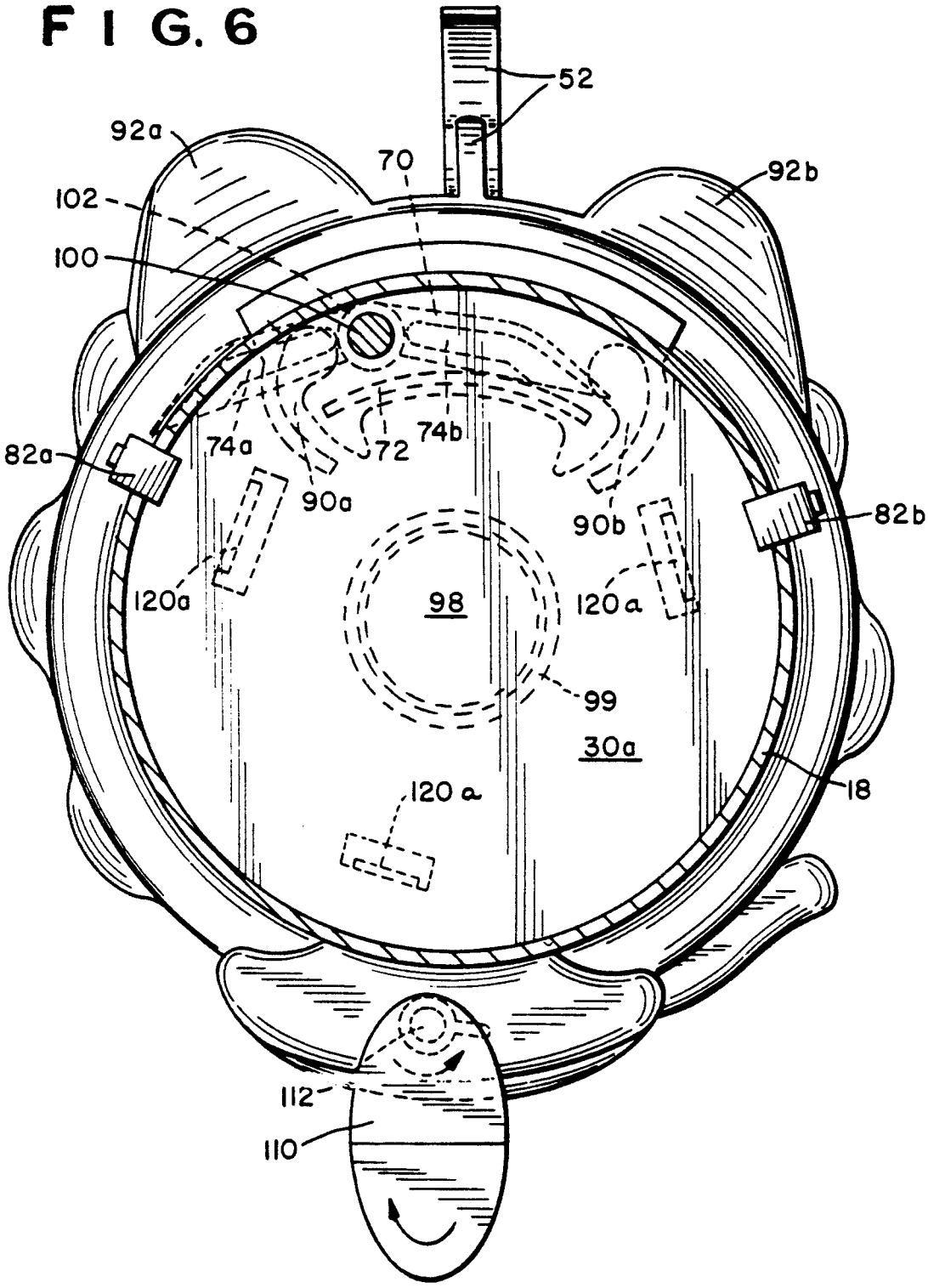
Figure 7:
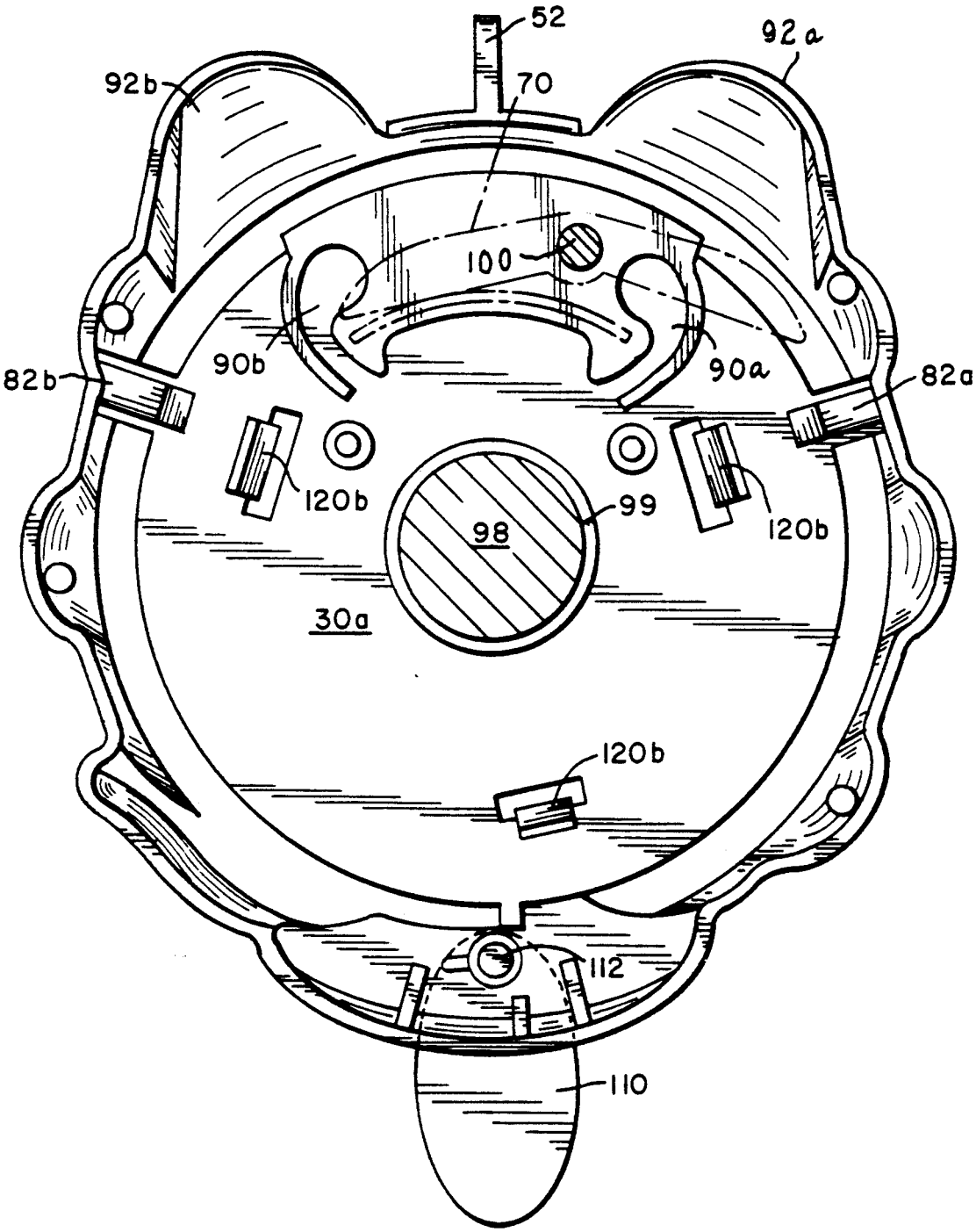

A floating element generally designated 70 is supported by a shoulder or shelf 72 of the collar 30 and adapted to move between two extreme positions, one of the extreme positions being illustrated in FIGS. 5 and 6, and the other extreme position being illustrated in FIG. 7 and in phantom line in FIG. 5. The floating element 70 defines adjacent each end thereof a channel 74a and 74b, respectively. When the floating element 70 is in one extreme position, as illustrated in FIGS. 5 and 6, the fluid emerging through chamber 62 from jet aperture 64a enters channel 74a and drives the floating element 70 away therefrom and to the other extreme position, illustrated in FIG. 7 and in phantom line in FIG. 5, where the fluid emerging from chamber 62 through jet aperture 64b enters channel 74b and drives the floating element 70 away therefrom and back again to the original extreme position. Accordingly, under the influence of the fluid jets from jet apertures 64a, 64b, the floating element 70 reciprocates along an arcuate axis, moving alternately clockwise and counterclockwise over a limited arc of about 120°. The significance of this movement of the floating element 70 will become apparent hereinafter.

Referring now to FIGS. 5 and 6 in particular, the chamber 62 of collar 30 also defines a pair of jet apertures 80a and 80b, generally adjacent the jet aperture 64a, 64b, respectively, and, like the jet apertures 64a, 64b, communicating with the interior of the chamber 62 and hence the fluid under pressure therein (as delivered by the conduit 36). The fluid jets emerging under pressure from the jet apertures 80a and 80b are received in aligned jet nozzles 82a and 82b, respectively, of collar 30. These jet nozzles 82a, 82b redirect the flow under pressure from jet apertures 80a, 80b towards the ears 20. Each flexible ear 20 is pivotally secured to the head 18 at by a respective pivot pin 86 (see FIG. 1). Under the influence of the fluid jets emerging from jet nozzles 82a and 82b, respectively, the large floppy ears 20 flap about the head 18, moving both backwards and forwards and inwardly and outwardly relative to head 18, as different parts of the ears 20 are hit by the respective emerging fluid jets. Because, as will be explained hereinafter, the head 18 is also rotating reciprocatingly relative to the stationary collar 30, the point of impact of the fluid jets from nozzles 82a, 82b on the ears 20 is constantly varying so that the flapping of the ears is essentially random.

The channels 74a and 74b of the floating element 70 are not only open at their free ends adjacent jet apertures 64a and 64b, respectively, but also have one open side through which the fluid entering the channels 74a, 74b can depart therefrom. As best seen in FIG. 6, the fluid flow leaving the channels 74a and 74b through the open sides thereof is directed, at least in major part, upwardly by baffles 90a and 90b, respectively, towards large deflectors 92a and 92b, respectively. The deflectors 92a, 92b in turn re-direct the fluid flow from channels 74a, 74b rearwardly as a spray. This spray serves two separate and distinct functions.

Primarily, the spray provides an area behind the FIG. 12 where children play in the spray, be cooled, etc. It will be appreciated that, with the exception of the relatively small fluid flow emerging from the jet apertures 80a, 80b and used to flap the ears, most of the fluid entering the collar chamber 62 emerges from jet apertures 64a, 64b and is eventually directed rearwardly to provide this spray so that a substantial amount of spray can be obtained.

The other function of the spray is to wag the tail 16. Preferably, the tail 16 is resiliently flexible, relatively broad (when viewed from the side, as seen in FIG. 1) and generally thin (when viewed from the edge). The tail 16 is secured to the torso 14 by a snap-in connection 94 which permits the tail to pivot from side to side—that is, to wag—under the influence of the two sprays directed thereagainst by the deflectors 92a, 92b. As the fluid flow from collar chamber 62 into the channels 74a, 74b of floating element 70 alternates, so does the power of the sprays directed against the tail 16 by the deflectors 92a and 92b (since the sprays are driven by the fluid received from the channels 74a, 74b). Accordingly, the sprays from the deflectors 92a, 92b cause the tail 16 to wag from one side to the other, relative to the torso 14.

Figure 8:
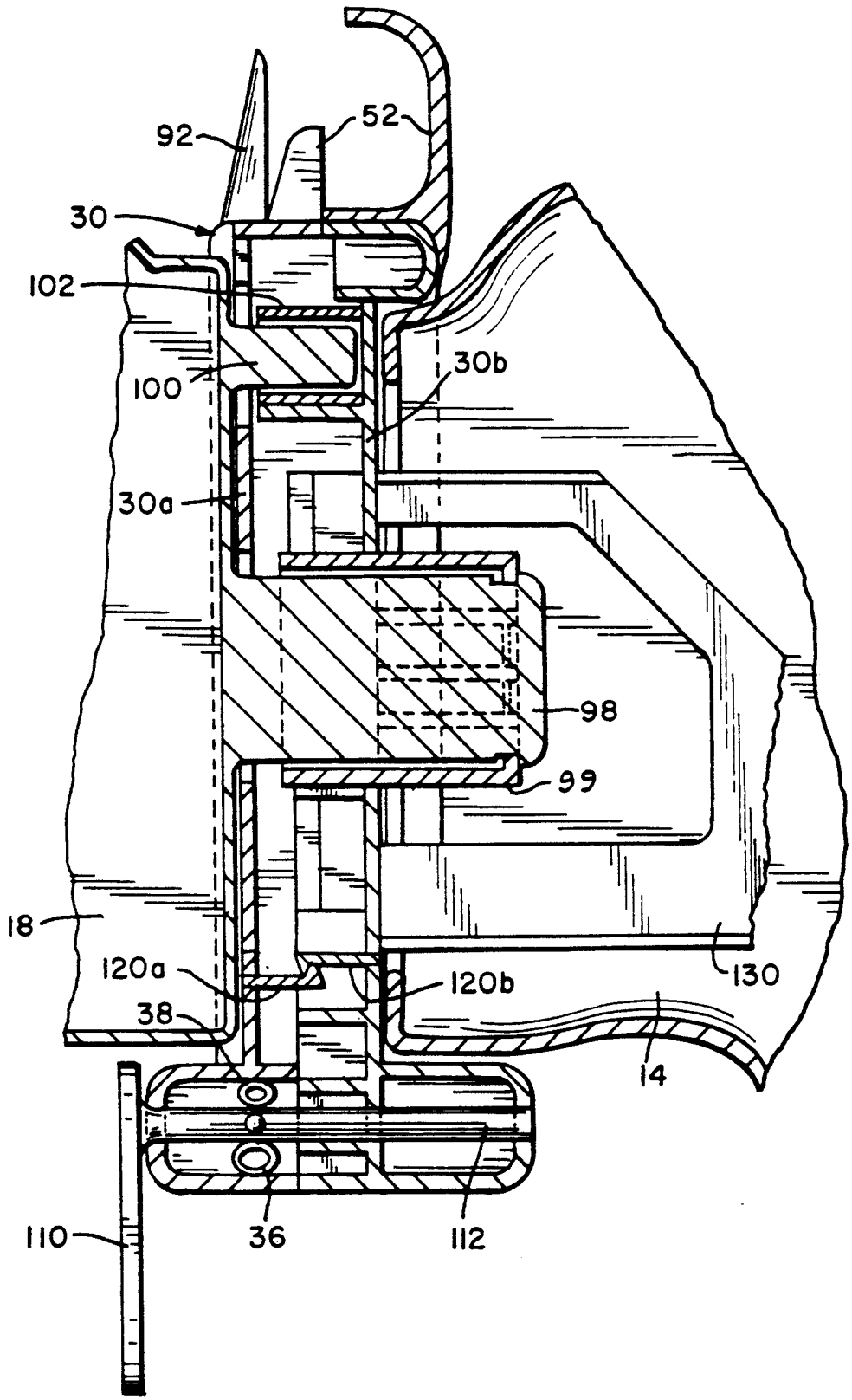
FIG. 8 is a fragmentary sectional view taken along the line 8—8 of FIG. 4.

To understand how the reciprocating movement of the floating element 70 causes the head 18 to rotate reciprocatingly along an arcuate axis relative to the stationary torso 14, it must be appreciated that, while the collar 30 is tightly secured about the neck 28 of the torso 14, the head 18 is primarily directly secured to the torso 14 by means of a snap-in connector 98 of head 18 which passes through and engages a bushing 99 of collar 30, the connection permitting free rotation of the head 18 relative to the torso 14, as best seen in FIGS. 2 and 8. However, the head 18 additionally has a rearwardly directed lug 100 which is received within a socket 102 of the floating element 70, centrally disposed intermediate the channels 74a, 74b. Thus, as the floating element 70 reciprocates back and forth between its extreme positions, its socket 102 carries lug 100 and hence head 18 with it, thereby effecting the desired reciprocating rotation of the head 18 relative to the stationary torso 14 over a limited arc corresponding to the arc through which the floating element 70 is moving.

Now that the effect of the fluid flow through conduits 36 and 38 has been described in detail, it will be appreciated that the pressure of the normally available water supply for a garden-type water sprayer is inadequate to provide both a desirable level of spray from conduit 38 and a desirable level of fluid flow (whether spray or stream) from conduit 36. Accordingly, in a preferred embodiment of the present invention, means are provided for blocking the fluid flow through a selected one of the conduits 36, 38 so that the full fluid flow is directed through the other of the conduits 38, 36.

Referring now to FIG. 5, the collar 30 is provided with a switch 110 which preferably has the appearance of a dog tag suspended from the collar 30. The tag 110 is secured to an eccentric cam 112 disposed intermediate the two conduits 36, 38, the tag 110 being capable of rotating the cam 112 between two extreme positions. In one extreme position (illustrated in phantom line extending downwardly to the left), the cam 112 pinches the flexible conduit 38 ,against a shoulder 114 of the collar so as to serve as a closed valve and preclude fluid flow through the conduit 38; in the other extreme position (illustrated in phantom line extending downwardly to the right), the cam 112 pinches the flexible, conduit 36 against a shoulder 116 of the collar 30 so as to serve as a closed valve and preclude fluid flow through the conduit 36. In the remaining views, the tag 110 is illustrated in a neutral position (see solid line orientation in FIG. 5.) leaving both valves open and typically not well suited for use. Appropriate legends may be disposed on the face of the tag 110 to indicate in which direction the tag should be turned in order to effect the desired fluid flow, either a fluid flow to the bone 46 for utilitarian purposes or a fluid flow to collar 30 which animates the FIG. 12 and provides a spray in which children can play.

Figure 4:
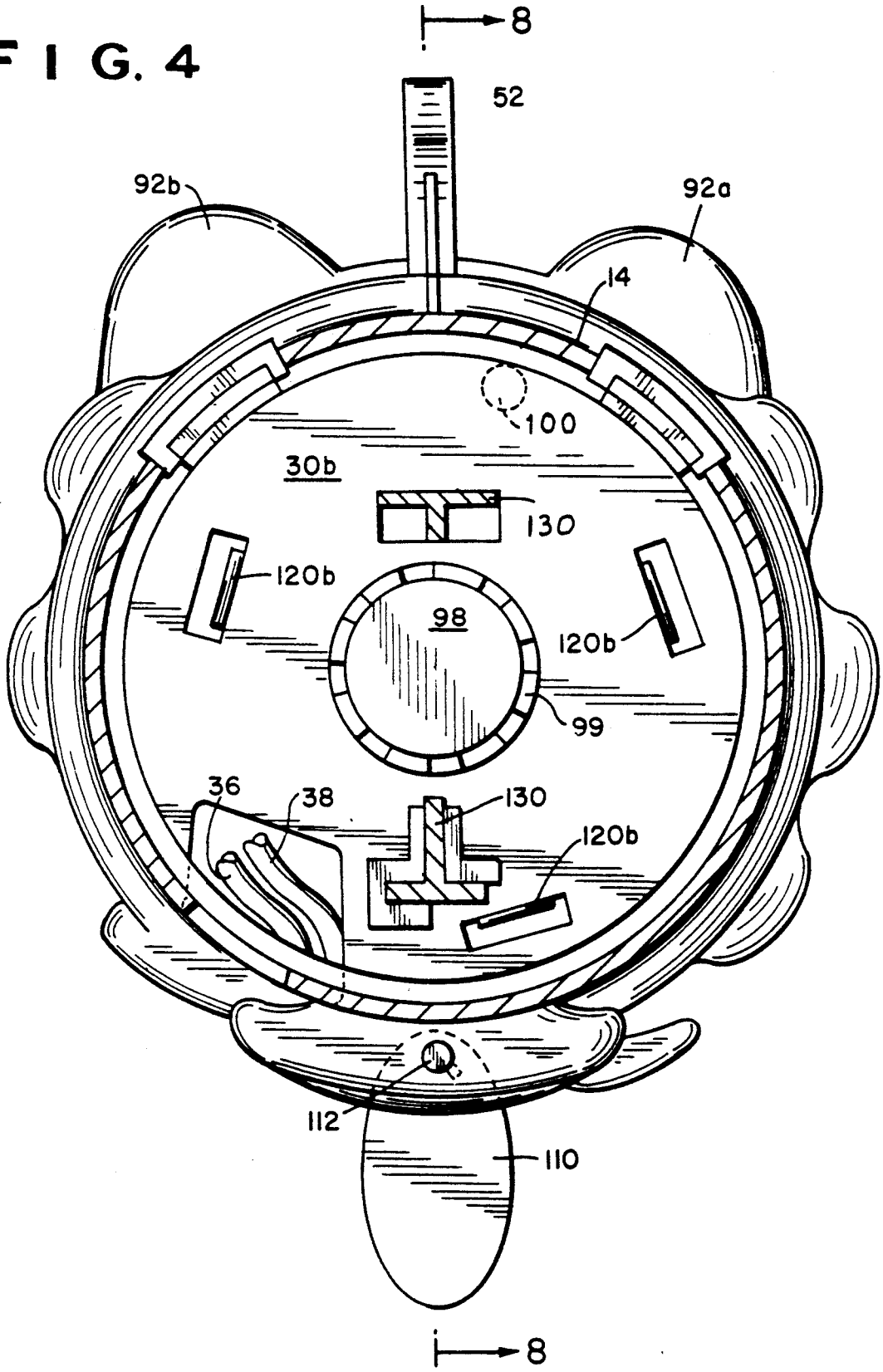
FIGS. 4, 5, 6 and 7 are fragmentary sectional views taken along the lines of 4—4, 5—5, 6—6 and 7—7 of FIG. 2.

For ease of manufacturing and assembly, the collar 30 is manufactured in two parts: a front collar portion 30*a* (best seen in FIGS. 6 and 7) and a rear collar portion 30*b* (best seen in FIGS. 4 and 5). The two collar portions 30*a*, 30*b* are easily assembled together (with the floating element 70 therebetween) by being appropriately aligned and pressed together so that the interengaging resilient projections 120*a* and 120*b* of the front and rear collar portions 30*a* and 30*b*, respectively, engage and resiliently lock together, thereby locking the collar portions 30*a*, 30*b* together. Various conventional rigid structures such as projections and recesses (wherein the projections of one portion are snugly received in recesses of the other portion) may additionally be used in order to preclude relative rotation of the collar portions 30*a*, 30*b*, once assembled together. The rear collar portion 30*b* is preferably rigidly secured to the intermediate nozzle part 40.

To use the sprayer, one has only to connect the input nozzle 34 to a source of liquid under pressure, such as a garden hose 32, and appropriately position the tag 110 to the type of action desired (that is, either fluid flow to the bone 46 or to the collar 30). If flow to the bone 46 is selected, the type of flow (either spray or stream) may be selected by appropriate positioning of the lever head 68, and the bone may be manually held, mounted horizontally in the mouth 50, or mounted vertically with an end thereof between arms 52. If fluid flow to the collar 30 is selected, the fluid flow into collar chamber 62 is diverted into pressurized jet streams to flap the ears 20 (via jet apertures and nozzles 80, 82) and pressurized jet streams from nozzles 64*a*, 64*b* to cause floating element 70 to reciprocate back and forth along an arcuate axis, thereby shaking the head 18. The streams emerging from the channels 74*a*, 74*b* of floating element 70 alternately hit deflector 92*a*, 92*b*, respectively, and are rearwardly directed toward the tail 16 to wag the tail 16 from side to side and then further provide a spray behind the figure in which children may frolic.

The fluid flow may be switched mid-stream between bone 46 and collar 30 by rotation of tag 110, and the fluid flow leaving the bone 46 may be switched mid-stream between stream and spray by use of lever head 68. If at any time flow is directed to the collar 30 and the head 18 does not shake, but remains dead center, a light tap on the head 18 to move it to one side or the other will normally suffice to move it off center and commence the desired shaking.

To summarize, the present invention provides an above-ground water distribution system which is aesthetically appealing, has a high degree of play value, and is interesting to watch in operation, even when the observer is not "playing" in the water emitted therefrom. The system is inexpensive and easy to manufacture, maintain and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A garden-type water sprayer comprising:

(A) a figure configured as an animal and defining a stationary body part and at least one movable body part; and (B) drive means mounted on said figure and adapted for fluid communication with a water supply under pressure, said drive means defining means for directing a water spray towards and directly against said at least one movable body part to move the same.

2. The sprayer of claim 1 wherein said drive means comprises at least a pair of jets for alternately directing a pair of water sprays towards and directly against said at least one movable part.

3. The sprayer of claim 1 wherein said stationary body part is the torso and limbs of said figure and said at least one movable body part includes the head of said figure, said figure further defining a neck connecting said head and said torso together while permitting limited movement of said head relative to said torso at least along a predetermined generally arcuate axis, and said drive means includes means for causing the water from the water supply to move said head relative to said torso to shake said head.

4. A garden-type water sprayer comprising:

(A) a figure configured as an animal defining:

(i) a torso;

(ii) a head; and (iii) a neck connecting said head and said torso together while permitting limited movement of said head relative to said torso at least along a predetermined generally arcuate axis; and (iv) at least one additional movable body part;

(B) a collar disposed about said neck and adapted for fluid communication with a water supply under pressure, said collar defining:

(i) at least a pair of jets for directing a water spray against said one additional movable body part to move the same; and (ii) means for causing the water from the water supply to move said head relative to said torso to shake said head.

5. A garden-type water sprayer comprising:

(A) a figure configured as an animal and defining:

(i) a torso;

(ii) a head;

(iii) a neck connecting said head and said torso together while permitting limited movement of said head relative to said torso at least along a predetermined generally arcuate axis;

(iv) a pair of ears secured to said head for movement relative thereto; and (v) a tail secured to said torso for movement relative thereto;

(B) a collar disposed about said neck and adapted for fluid communication with a water supply under pressure, said collar defining:

(i) at least a pair of rearwardly directed jets for alternately directing water sprays against said tail to wag said tail, (ii) at least a pair of forwardly directed jets for directing a water spray against each of said ears to flap said ears, and (iii) means for causing the water from the water supply to move said head relative to said torso to rotate said head.

6. The sprayer of claim 5 additionally including an output nozzle configured as a bone and a flexible conduit of appreciable length configured as a leash for fluid communication between said output nozzle and said collar.

7. The sprayer of claim 6 wherein said head defines a mouth configured and dimensioned to receive and releasably maintain said output nozzle in said mouth.

8. The sprayer of claim 6 additionally including a tag secured to said collar and movable between a spray-feed orientation and a nozzle-feed orientation, and a tap-operated valve operably connected to said tag and disposed in said collar, said valve being in fluid communication with said jets and head-moving means when said tag is in said spray-feed orientation and in fluid communication with said nozzle when said tag is in said nozzle-feed orientation.

9. The sprayer of claim 5 wherein said torso is hollow and defines a connector in fluid communication with a water supply under pressure at one end and said collar at the other end.

10. The sprayer of claim 5 additionally including means securing said tail to said torso while permitting limited lateral movement of said tail relative to said torso under the impact of the water sprays.

11. The sprayer of claim 5 additionally including means securing each of said ears to said head while permitting pivotal motion of said ears under the impact of the water sprays.

12. The sprayer of claim 5 wherein said tail is flexible and wags under the alternating impacts of the water sprays.

13. The sprayer of claim 5 wherein each of said ears is flexible and flaps under the impact of the water spray.

14. The sprayer of claim 5 wherein said neck enables limited rotational motion of said head relative to said torso.

15. The sprayer of claim 14 wherein said neck enables limited horizontal and vertical motion of said head relative to said torso.

16. The sprayer of claim 5 wherein the water from the water supply passes through said head-moving means of said collar prior to entering said rearwardly directed jets of said collar.

17. A garden-type water sprayer comprising: (A) a figure configured as an animal defining:

(i) a torso;

(ii) a head defining a mouth;

(iii) a neck connecting said head and said torso together while permitting limited horizontal and vertical movement of said head relative to said torso at least along predetermined generally horizontal and vertical axes;

(iv) a pair of flexible ears and means securing each of said ears to said head while permitting pivotal motion of said ears under the impact of water sprays;

(v) a flexible tail and means securing said tail to said torso while permitting limited lateral movement of said tail relative to said torso under the impact of water sprays;

(B) a collar disposed about said neck and adapted for fluid communication with a water supply under pressure, said collar defining:

(i) at least a pair of rearwardly directed jets for directing alternate water sprays against said tail to wag said tail, (ii) at least a pair of forwardly directed jets for directing a water spray against each of said ears to flap said ears, and (iii) means for causing the water from the water supply to move said head relative to said torso to rotate said head;

at least some of the water from the water supply passing through said head-moving means of said collar prior to entering said jets of said collar;

(C) a nozzle shaped as a bone configured and dimensioned to be received and releasably maintained in said mouth, and a flexible conduit of appreciable length configured as a leash for fluid communication between said nozzle and said collar; and (D) a tag secured to said collar and movable between a spray-feed orientation and a nozzle-feed orientation, and a valve operably connected to said tag and disposed in said collar, said valve being in fluid communication with said jets and head-moving means when said tag is in said spray-feed orientation and in fluid communication with said nozzle when said tag is in said nozzle-feed orientation.

* * * * *